United States Patent [19]

Ito et al.

[11] Patent Number: 5,007,383

[45] Date of Patent: Apr. 16, 1991

[54] WATER-COOLING SYSTEM FOR A WATER-COOLED HORIZONTAL CYLINDER ENGINE

[75] Inventors: Ryoichi Ito; Koji Iwai; Tsuyoshi Nishida, all of Sakaishi, Japan

[73] Assignee: Kubota Limited, Japan

[21] Appl. No.: 396,503

[22] Filed: Aug. 21, 1989

Related U.S. Application Data

[62] Division of Ser. No. 139,753, Dec. 30, 1987, Pat. No. 4,883,024.

[30] Foreign Application Priority Data

Jan. 23, 1987 [JP] Japan ..... 62-15001

[51] Int. Cl.[5] ..... F01P 1/02

[52] U.S. Cl. ..... 123/41.49; 123/41.7; 123/195 HC; 123/198 E

[58] Field of Search ..... 123/41.49, 41.7, 198 E, 123/196 W, 195 HC; 180/68.4, 68.22, 68.23; 181/204

[56] References Cited

U.S. PATENT DOCUMENTS

| | | | |
|---|---|---|---|
| 1,920,883 | 8/1933 | Perkins | 123/41.49 |
| 2,499,176 | 2/1950 | Barrell | 123/41.49 |
| 3,949,727 | 4/1976 | Thien et al. | 123/198 E |
| 4,226,214 | 10/1980 | Palazzetti | 123/198 E |
| 4,548,164 | 10/1985 | Ylonen et al. | 123/198 E |
| 4,716,984 | 1/1988 | Hiramatsu et al. | 123/195 HC |
| 4,864,981 | 12/1989 | Takada et al. | 123/198 E |
| 4,883,024 | 11/1989 | Ito et al. | 123/41.7 |

FOREIGN PATENT DOCUMENTS 57-182159 7/1982 Japan .

*Primary Examiner*—Craig R. Feinberg
*Attorney, Agent, or Firm*—Lowe, Price, LeBlanc, Becker & Shur

[57] ABSTRACT

In a water-cooling system for a water-cooled horizontal engine, a radiator and a radiator fan are arranged at the front of a cylinder head which is mounted forwardly of a cylinder block of the engine. A radiator fan generates a cooling air flow which passes through the space over the cylinder head and toward the radiator, the height of the radiator being sized to match the width of the cylinder block measured in the upward and downward direction.

6 Claims, 3 Drawing Sheets

WATER-COOLING SYSTEM FOR A WATER-COOLED HORIZONTAL CYLINDER ENGINE

This is a division of application Ser. No. 07/139,753, now U.S. Pat. No. 4,883,024, filed Dec. 30, 1987.

BACKGROUND OF THE INVENTION

1. Field of the Invention

The present invention relates to a water-cooling system for a water-cooled horizontal cylinder engine which is installed with the axes of a crank shaft and a cylinder thereof disposed to be horizontal, in the transverse direction for the former and in the forward and backward direction for the latter.

2. Background of the Prior Art

A conventional water-cooled horizontal cylinder engine, as depicted in FIG. 5, such as the one shown in Japanese Patent Publication No. 35408, 1982, has a radiator 103 and a fuel tank mounted over the foreside and the backside of a cylinder block 100 laid sideways in a water-cooled horizontal cylinder engine E. A radiator fan 104 is mounted at, for example the left side of the radiator 103 located at the front upper side of the cylinder block 100 and a cooling air passage is provided so as to run through the radiator fan 104 in the left and right direction over the cylinder block 100.

However, in the above-mentioned prior art, since the horizontal cylinder engine E has a radiator 103 mounted thereon, the total height of the engine E becomes large corresponding to that of the radiator 103.

Further, since a cylinder head 105 of the horizontal cylinder engine E is disposed at the front lower section of the engine E, it takes position remote from and downward with respect to the radiator fan 104 which is located at the upper and fore section of the engine E. Hence the cylinder head 105 is not cooled well directly by the cooling air flow delivered by the radiator fan 104, and much heat generated from the cylinder head 105 is not radiated effectively around the engine E but tends to be confined close thereto.

On the other hand, in an engine of the type shown in FIG. 6 and in a water-cooled vertical cylinder engine as shown in U.S. Pat. No. 4,122,353, since a radiator **103*a*** is arranged at the foreside of the engine E instead of the upper side thereof the problem of the total height of the engine of the type having a radiator mounted thereon becomes serious as mentioned above.

However, since such a water-cooled vertical cylinder engine has a cylinder head **105*a* secured on the upper side of the cylinder block, it is relatively high originally and, further, the height of the radiator 103*a* is limited correspondingly by that of the cylinder head 105*a* because upper and lower tanks 113*a*, 113*b* of the radiator 103*a* are connected to a water jacket of the engine E through a hot water pipe 116 and a cold water pipe 117**. The overall height of this engine cannot be reduced remarkably in comparison with that of the horizontal cylinder engine.

It is desirable that the overall height of the engine be reduced by shifting the radiator **103*a* downward, so that the upper tank 113*a* of the radiator 103*a* is located below the cylinder head 105*a*. However, since the upper tank 113*a* of the radiator 103*a*** is located below the cylinder jacket, it becomes necessary to force downward by means of a water pump opposite to the natural convection, the hot water which tends to ascend due to its decreased density after its completion of heat exchange. As a result, the cooling water is hindered from circulating smoothly and the cooling performance is degraded.

SUMMARY OF THE INVENTION

Accordingly, it is an object of the present invention to obtain superior circulation of a cooling water in a water-cooling system for a water-cooled horizontal cylinder engine while the overall height of the water-cooled engine is constrained to be comparatively low.

It is another object of the present invention to rapidly remove the heat generated from a hot cylinder head during the operation of a water-cooled engine.

For accomplishing the above-mentioned objects, the present invention provides a water-cooling system for a water-cooled horizontal cylinder engine, comprising a cylinder head arranged at the foreside of a cylinder block of the engine, a radiator mounted to be facing forward and having a fan disposed in the foreside space of the cylinder head, a hot water pipe and a cold water pipe through which the radiator and a water jacket formed in the engine are connected each other, and a cooling air passage through which a flow of cooling air is forced to pass at least from the space over the cylinder head to the radiator by the suction caused by operation of the fan.

In the above-mentioned water-cooling system for the water-cooled horizontal cylinder engine, the radiator is located at the foreside of the cylinder block of the engine laid sideways, the height of the radiator is dependent only on the width of the cylinder block in the upward and downward direction thereof and consequently, the overall height of the engine can be restrained to be comparatively low.

Since the upper portion of the radiator is not located below the water jacket of the engine, ascending hot water is introduced from the water jacket to the radiator in accordance with the natural flow direction thereof; so as to provide smooth circulation of the cooling water.

Further, since cooling air is directed to be forcibly delivered by the radiator fan to pass forward through the space over the cylinder head, so that the heat generated from the hot cylinder head is removed forward by the cooling air flow, the water-cooled horizontal cylinder engine can be utilized as an engine working machinery without any thermal influence on the working machinery.

The foregoing and other objects and attendant advantages of the present invention will be readily appreciated as the same become better understood by reference to the following detailed description when considered with the accompanying drawings, wherein:

DETAILED DESCRIPTION OF THE EMBODIMENT

Figure 1:
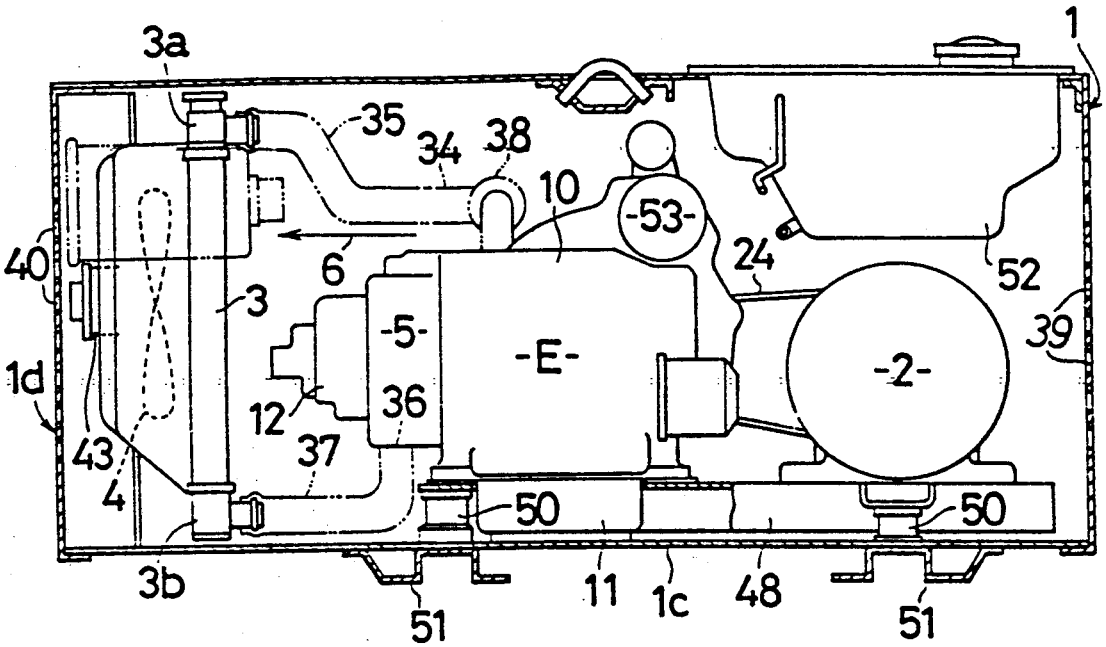
FIG. 1 is a vertical right side view of a sound-proof engine powered generator employing a water-cooled horizontal cylinder engine according to a preferred embodiment of the present invention.
Figure 2:
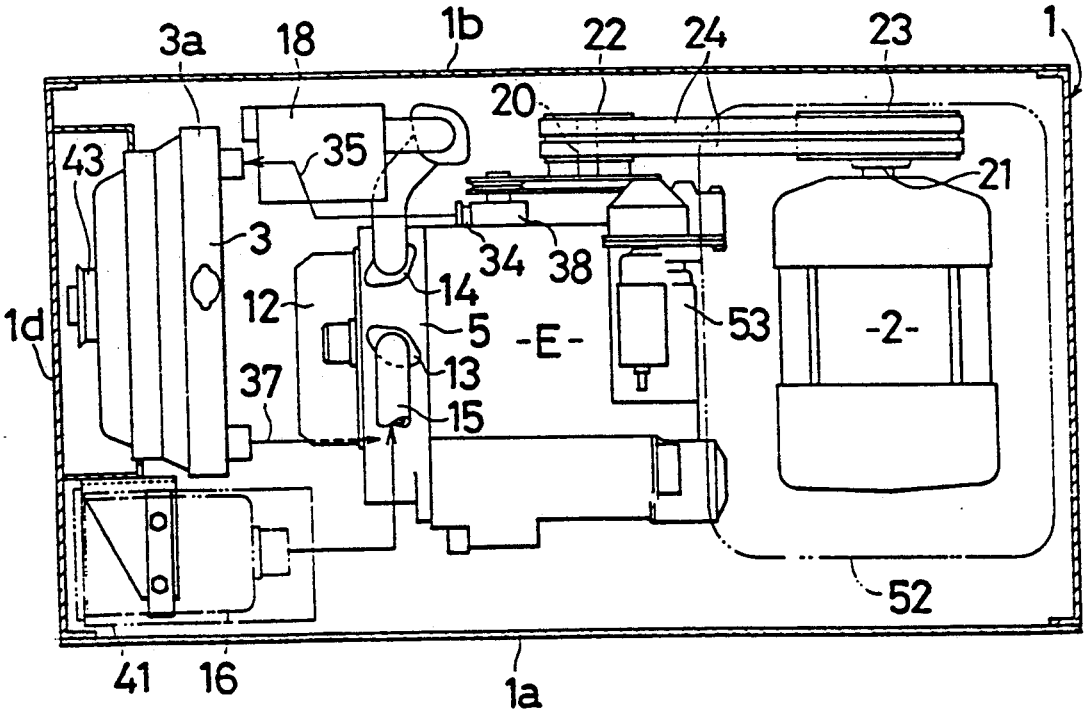
FIG. 2 is a horizontal plan view of the engine powered generator of FIG. 1.

A preferred embodiment of the present invention, applied to a sound-proof engine powered generator employing a water-cooled horizontal cylinder engine will be explained with reference to the drawings hereinafter.

In the sound-proof engine powered generator, a generator 2 is arranged at the rear of the centrally located water-cooled horizontal cylinder engine E and a radiator 3 and a radiator fan 4 are arranged respectively at the front of the engine E. Generator 2, radiator 3, fan 4 and engine E are all enclosed by a sound-proof casing 1 of a rectangular prism-like configuration.

In the water-cooled horizontal cylinder engine E, a cylinder block 10 has a cylinder formed at the core portion thereof. A piston is mounted horizontally slidably in the cylinder and is interlocked to a crank shaft 20.

The cylinder block 10 has an oil pan 11 fixedly secured to the underside thereof and a cylinder head 5 with a head cover 12 fixedly secured to the foreside thereof.

Figure 6:
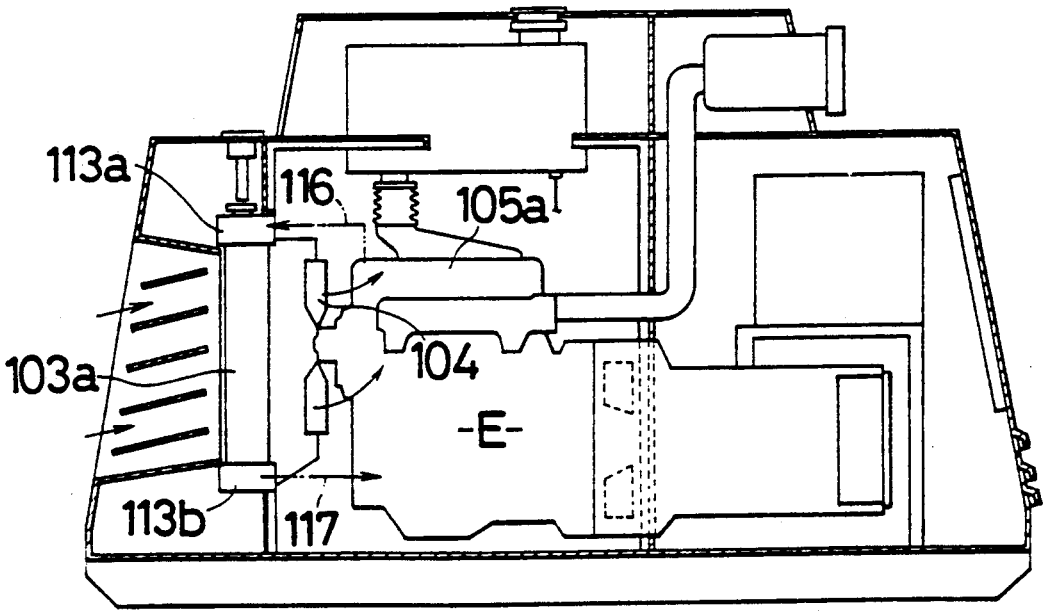
Fig. 6 PRIOR ART
FIG. 6 is a vertical sectional right side view of a conventional sound-proof engine powered generator employing a water-cooled vertical cylinder engine illustrated in FIG. 1.

The cylinder head 5 is provided with an intake port 13 and an exhaust port 14. The intake port 13 is connected to an air cleaner 16 through an intake pipe 15, and the exhaust port 14 is connected to a muffler 18 through an exhaust pipe 17. Muffler 18, as best seen in FIG. 6, is located to one side of the cylinder head, between the engine and the radiator.

The crank shaft 20 of the engine E and the rotary shaft 21 of the generator 2 are supported rotatively and in parallel each other and provided with a driving pulley 22 for the former and a driven pulley, for the latter 23 respectively, both of which are corrected by a belt 24 so that the engine E and the generator 2 are connected to each other in an interlocked relation.

The water jacket of the horizontal cylinder engine E comprises a cylinder jacket formed in the cylinder block 10 and a head jacket formed in the cylinder head 5.

The upper tank 3*a* of the radiator 3 is connected to the outlet port 34 of the cylinder jacket through the hot water pipe 35, and the lower tank 3*b* is connected to inlet port 36 of the cylinder jacket through the cold water pipe 37. A water pump 38 is mounted to the outlet port 34 and is corrected to the crank shaft 20 and serves to circulate a cooling water flow so that a hot water in the cylinder jacket, which absorbs the heat from the cylinder head 5 and the cylinder, is sent to the radiator 3 through the hot water pipe 35 to be cooled therein and is then returned to the head jacket through the cold water pipe 37.

In this construction, since the height of the radiator 3 is restrained only by that of the cylinder block 10 disposed in a horizontal state in the engine E so as to be low, the height of the sound-proof casing 1 also can be reduced in correspondence with that of the radiator 3.

Since the height of the radiator 3 is constrained as mentioned above, the lengths of the hot water pipe 35 and the cold water pipe 37 can also be reduced, so that the reductions of the water pump dimension and the manufacturing cost are attained significant in comparison to those for a conventional embodiment employing a vertical cylinder engine.

On the other hand, the radiator fan 4 comprises a suction fan of the axial flow type which is located at the foreside of the radiator 3 and is driven by a fan motor 43 electrically connected to a battery 41, acting as a power source located at the right and front side of the radiator 3.

The radiator fan 4 sucks in ambient air as cooling air through the intake apertures 39 provided at the central as well as the rear portions of the left side wall 1*b*, at the foreside of the right side wall 1*a*, and at the bottom wall 1*c* of the sound-proof casing 1. The cooling air introduced into the casing 1 flows through the radiators 3 while cooling the generator 2, the horizontal cylinder engine E and the radiator 3 and is then discharged to the outside through air outlet 40 opened in the foreside wall 1*d* of the casing 1.

In this case, since a portion of the cooling air passage 6 is formed in the space over the cylinder head 5, so as to run from the backside portion of the engine E to the radiator 3 at the foreside thereof, the heat generated from the hot cylinder head 5 is rapidly removed to the outside by the cooling air flowing through the radiator 3 and out the air outlet 40. Accordingly, the heat generated from the cylinder head 5 is not confined within the sound-proof casing 1, and the generator 2 (including a switchboard) can be protected effectively from the heat.

On the other hand, since the belt 24 which serves to interlock the horizontal cylinder engine E and the generator 2 is subjected to a reduction of the tension due to its sagging in the course of a long time operation, an automatic tension regulator 25 is provided in order to always keep the belt 24 in a tensed state.

Figure 4:
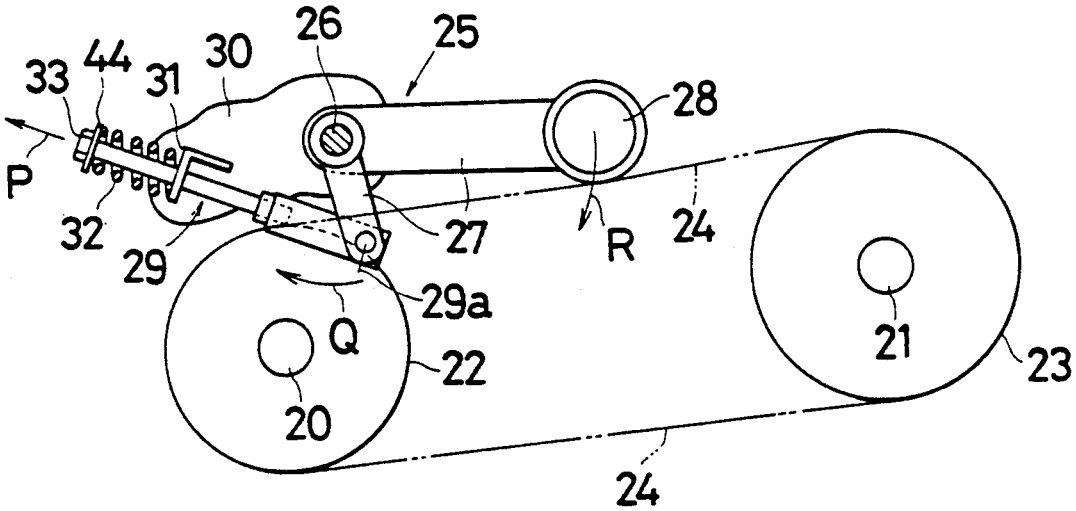
FIG. 4 is a schematic explanatory view of an automatic tension regulator.
Figure 5:
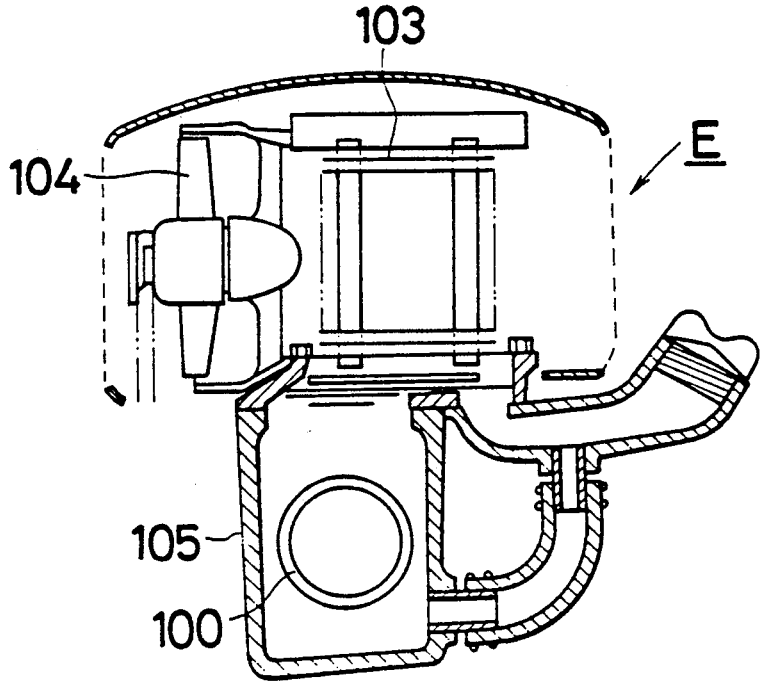
Fig. 5 PRIOR ART
FIG. 5 is a schematic perspective view showing a conventional sound-proof engine powered generator.

As shown in FIG. 4, the automatic tension regulator 25 comprises a tension pulley 28, a bell crank arm 27, a regulation rod 29 and a compression spring 32. The bell crank arm 27 is pivotably supported by a pivot 26 and is rotatively connected at one end thereof to the tension pulley 28 arranged so as to abut to the belt 24, as well as at the other end thereof to the output portion 29*a* of the regulation rod 29.

The regulation rod 29 is supported slidably by a bracket member 31 fixed to the engine body and is always biassed in the direction of the arrow P opposite to the bracket 31 by a compression spring 32 retained between the bracket 31 and the retainer flange 29*b* provided at the free end thereof.

The symbol 33 indicates a screw for the regulation of the resilient biasing force of the compression spring 32.

In the tension regulator 25, since the regulation rod 29 is biassed in the direction of the arrow P by the resilient biassing force of the compression spring 32, the bell crank arm 27 pivotably connected to the output portion 29*a* thereof is swung about the pivot 26 generally in the direction of the arrow Q, so as to apply a tension to the belt 24 by the tension pulley 28 swung in the direction of the arrow R as the result.

Figure 3:
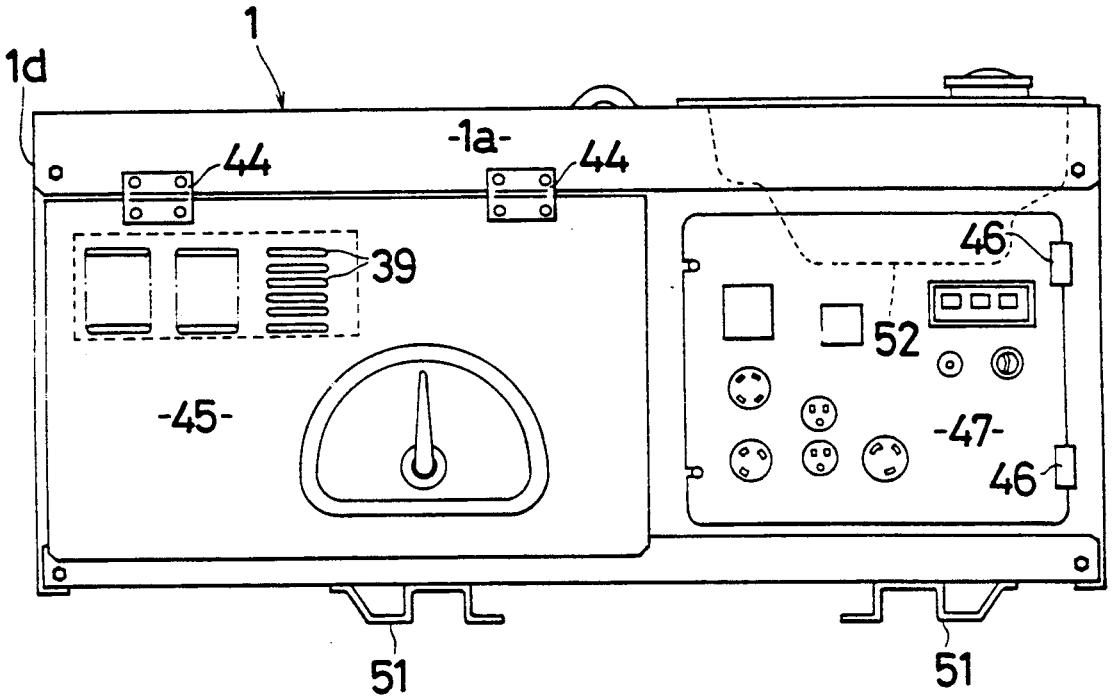
FIG. 3 is a right elevation view of the engine generator.

As shown in FIG. 3, in the right side wall 1*a* of the sound-proof casing 1, there are provided a door 45 for maintenance and an operation panel 47 in parallel. The door 45 is pivotably connected to the casing 1 by hinges 44 so as to be opened upward. The operation panel 47 is also pivotably connected to casing 1 by hinges 46 so as to be opened sideways. Further, the cable connection portions of the generator 2 are concentrated at the side of the maintenance door 45 so that the maintenance and the working operations can be carried out quickly and readily due to the access thereto from the same location (accordingly, the right side wall 1*a* is defined as the front side when taking account of the convenience of the working and the operation for the engine driven machinery).

The horizontal cylinder engine E and the generator 2 are installed on a common bed 48, which is fixedly secured onto the bottom wall 1*c* of the sound-proof casing 1 through vibro-isolating rubber supports 50.

Fixation members 51 are attached to the bottom wall 1*c* of the sound-proof casing 1. In the event that wheels are mounted to the fixation members, the sound-proof casing 1 can be converted to be of the portable type.

The symbol 52 indicates a fuel tank disposed above the generator 2, and the symbol 53 indicates a self-starter for the engine E.

Since the present invention is characterized in that the radiator and the radiator fan are arranged in front of the cylinder head of the water-cooled horizontal engine and the cooling air passage is provided in the space over the cylinder head for the cooling air to be allowed to pass therethrough from the backside to the foreside by the radiator fan, the water-cooled horizontal cylinder engine can be utilized as a prime mover and may also applied as an engine to drive machinery, e.g. an engine generator, an engine compressor, an engine welder, an engine-driven pump and the like.

The sound-proof casing is optionally assembled to the engine and connected to enclose the whole of the engine working machinery. But, for example in the engine generator enclosed by the casing as explained in the above-mentioned embodiment, since the size of the whole casing can be reduced to be compact, the engine generator can be put into the space provided between the wheels and below the floor of a vehicle body or into the space between legs of a table in a cabin or when being carried by a camping car.

In the case of the transfer by a van, the engine powered generator can be put on a rear cargo carrier in a space-efficient manner. As noted above, the engine powered generator according to the present invention can be made very compact.

What is claimed:

1. A water-cooling system for a water-cooled horizontal cylinder engine, comprising:

a cylinder head provided in front of a cylinder block of the water-cooled horizontal cylinder engine;

a forwardly facing radiator, located substantially in front of and with its rear facing the cylinder head;

a radiator fan disposed to face the radiator;

a water jacket formed in the cylinder block and the cylinder head, an outlet port of the water jacket being connected to an inlet port of the radiator through a hot water pipe therebetween, and a water outlet port of the radiator being connected to an inlet port of the water jacket through a cool water pipe therebetween; and an air cleaner and a muffler provided to be located forwardly of the engine, one to the left and the other to the right thereof and opposing each other when seen from the cylinder head, the air cleaner and muffler each being disposed so as to not extend above a maximum height of said radiator, and the muffler being positioned to one side of the cylinder head and substantially between the cylinder head and the radiator.

2. A water-cooling system for a water-cooled horizontal cylinder engine according to claim 1, wherein:

the air cleaner is located forwardly of the cylinder head and to one side of both the cylinder head and the radiator.

3. A water-cooling system for a water-cooled horizontal cylinder engine according to claim 1, wherein:

the water-cooled horizontal cylinder engine is enclosed within a sound proof casing provided with an access door for maintenance purposes in a side wall of the sound-proof casing, said air cleaner is provided close to the maintenance door and said muffler is provided further away from the maintenance door than said air cleaner.

4. A water-cooling system for a water-cooled horizontal cylinder engine, comprising:

a cylinder head provided in front of a cylinder block of the water-cooled horizontal cylinder engine;

a forwardly facing radiator, located substantially in front of and with its rear facing the cylinder head;

a radiator fan disposed to face the radiator;

a water jacket formed in the cylinder block and the cylinder head, an outlet port of the water jacket being connected to an inlet port of the radiator through a hot water pipe therebetween, and a water outlet port of the radiator being connected to an inlet port of the water jacket through a cool water pipe therebetween; and an air cleaner and a muffler provided to be located forwardly of the engine one to the left and the other to the right thereof and opposing each other when seen from the cylinder head, the air cleaner being disposed so as to not extend above a maximum height of said radiator, and the muffler being disposed a little forwardly of and to one side of the cylinder head and to the rear of the radiator.

5. A water-cooling system for a water-cooled horizontal cylinder engine according to claim 4, wherein:

the air cleaner is located forwardly of and to one side of the cylinder head.

6. A water-cooling system for a water-cooled horizontal cylinder engine according to claim 4, wherein:

the water-cooled horizontal cylinder engine is enclosed within a sound-proof casing provided with an access door for maintenance purposes in a side wall of the sound-proof casing, said air cleaner is provided close to the maintenance door and said muffler is provided further away from the maintenance door than said air cleaner.

* * * * *